United States Patent [19]

Nowak et al.

[11] Patent Number: 4,675,623

[45] Date of Patent: Jun. 23, 1987

[54] ADJUSTABLE CAVITY TO MICROSTRIPLINE TRANSITION

[75] Inventors: Michael E. Nowak, Schaumburg; Christopher R. Bach, Elgin, both of Ill.

[73] Assignee: Motorola, Inc., Schaumburg, Ill.

[21] Appl. No.: 835,087

[22] Filed: Feb. 28, 1986

[51] Int. Cl.[4] ..... H01P 5/107

[52] U.S. Cl. ..... 333/26; 333/33; 333/230

[58] Field of Search ..... 333/21 R, 26, 33, 230, 333/232

[56] References Cited

U.S. PATENT DOCUMENTS

| | | | |
|---|---|---|---|
| 2,443,921 | 6/1948 | Moe | 333/33 X |
| 2,588,103 | 3/1952 | Fox | 333/33 X |
| 3,136,946 | 6/1964 | LeVine . | |
| 3,638,148 | 1/1972 | Hallford et al. | 333/21 R X |
| 3,721,921 | 3/1973 | Lamy et al. | 333/21 R X |
| 3,924,204 | 5/1974 | Fache et al. . | |
| 3,969,691 | 6/1975 | Saul . | |
| 4,006,425 | 6/1977 | Chang et al. . | |
| 4,211,987 | 11/1977 | Jing-Jong Pan . | |
| 4,232,277 | 3/1979 | Dickens et al. . | |
| 4,453,142 | 6/1984 | Murphy . | |

FOREIGN PATENT DOCUMENTS

| | | | |
|---|---|---|---|
| 9348 | 1/1977 | Japan | 333/33 |

OTHER PUBLICATIONS

"Microstripline for Microwave Integrated Circuits", M. V. Schneider, Bell Systems Technical Journal, May-Jun. 1969, pp. 1421-1444.

*Primary Examiner*—Paul Gensler

*Attorney, Agent, or Firm*—Robert J. Crawford

[57] ABSTRACT

Disclosed is a coupling arrangement which comprises an enclosed cavity with an aperture in one of its walls. An adjustable probe is positioned within the aperture to allow energy within the cavity to be coupled onto the probe. A microstripline transition is connected at one end to the adjustable probe and at the other end to external circuitry. The arrangement allows variable coupling of energy within the cavity onto the probe without requiring cumbersome procedures for fine adjustment.

7 Claims, 2 Drawing Figures

Fig. 1
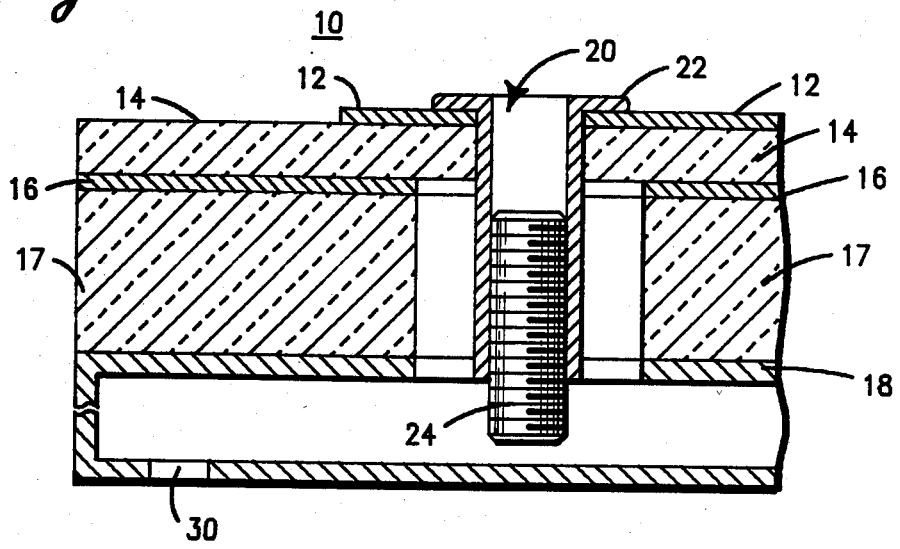
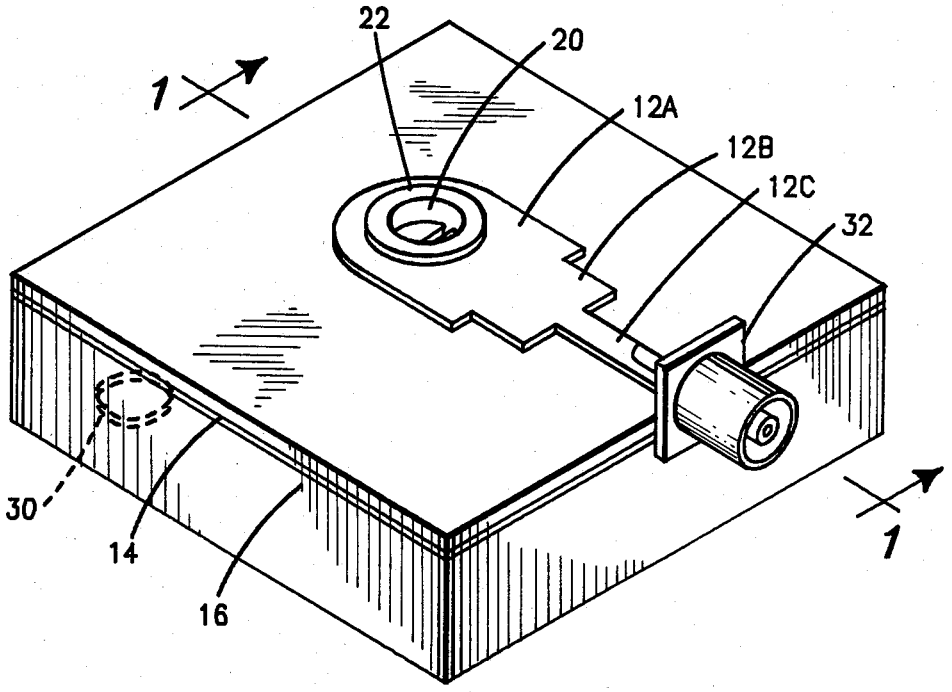
Fig. 2

ADJUSTABLE CAVITY TO MICROSTRIPLINE TRANSITION

BACKGROUND OF THE INVENTION

The present invention relates to an apparatus for coupling energy in a cavity resonator to a microstripline circuit, and more particularly, to an apparatus for variably coupling such energy.

Cavity resonators and microstripline circuits are well know in the art of employing high frequency electromagnetic energy. A cavity is a hollow conductive circuit sometimes having a rectangular box-like shape and is typically used as a frequency resonant element. A microstripline circuit is used to propagate electromagnetic energy and consists of a ground plane and a foil strip separated by dielectric material. Although microstripline circuits are more subject to radiation losses than are other transmission structures, such as waveguides, they may be inexpensively constructed by familiar photo etching techniques. Moreover, microstripline circuits may be interfaced quite easily with a variety of electronic components using minimal circuit board real estate.

In many systems, such as point-to-point radio communication systems, it is necessary to interface energy in a resonant structure to various portions of the system. There are a number of techniques that perform this interface.

One example is a commercially available microwave duplexer in which resonant energy is coupled from a resonant structure to external circuitry using a metal rod affixed with a dielectric sleeve in a metal bushing which is mounted perpendicular to a wall and partially extending into the resonant structure. The electromagnetic energy is coupled to the metal rod and out through a coaxial cable attached thereto. A critical aspect of such a design is the availabilty to adjust the coupling such that the Q of the resonant structure coupled through the probe may be set according to desired specification. To accomplish this task, one of two procedures may be used. The first procedure involves turning the bushing in the structure until the desired Q is obtained. However, changing the depth of the bushing can significantly alter the resonant frequency itself.

The second procedure involves trimming the length of the metal rod. This requires removing the metal bushing from the cavity, trimming the rod, reinserting the bushing, and measuring for the desired Q. If the Q is not found to agree with specification, the procedure must be repeated. Not only is this second procedure overly cumbersome, but a replacement rod is required if the metal rod is trimmed too far.

There are still other techniques known in the art which utilize microstripline circuits to couple energy from a waveguide to external circuitry. One such example is described in Murphy—U.S. Pat. No. 4,453,142, assigned to the same assignee of the present invention. Murphy describes a microstripline waveguide transition which uses the microstripline to extract the energy from the waveguide. The microstripline is mounted at a right angle on a wall of the waveguide. The microstripline is preformed into a transition section and a probe section. Energy in the waveguide is coupled to the probe and onto the external microstripline through the transition section. The transition section width is formed as narrow as possible to minimize capacitive coupling to the waveguide wall and is limited to a length of an integral multiple of one-half the wavelength for a smooth impedance match from the probe to the microstrip. Although this invention alleviates certain problems discussed therein, it requires very detailed probe manufacturing to obtain a given coupling. Furthermore, this kind of transition is not practical for cavity resonators which are tuned over a wide range of resonant frequencies since it cannot be adjusted.

What is needed is a cavity to microstripline transition which can easily be adjusted to couple the required amount of high frequency energy to microstripline circuitry.

SUMMARY OF THE INVENTION

Accordingly, it is an object of the present invention to provide coupling for a cavity to microstripline transition which solves the above mentioned problems.

It is a further object of the present invention to provide a coupling apparatus between microstripline and an enclosed cavity which can readily be adjusted by rotatably moving a cylinder within an aperture disposed within one cavity wall.

A particular embodiment of the present invention comprises a cavity with an aperture in one of its walls. An adjustable probe is positioned within the aperture to allow energy within the cavity to be coupled onto the probe. A microstripline transition is connected at one end to the adjustable probe and at the other end to external circuitry.

The adjustable probe is preferably composed of an outer metallic bushing and an inner cylinder. The metallic bushing is fixed in the aperture. The inner cylinder is adjustable within the outer bushing, having a variable depth into the cavity. By adjusting the depth of the cylinder, the desired coupling between the cavity and the microstripline transition can easily be realized to obtain the desired Q of the resonant structure.

These and other objects and advantages of the present invention will be apparent to one skilled in the art from the detailed description below taken with the drawings.

BRIEF DESCRIPTION OF THE DRAWINGS

FIG. 1 is a cavity wall cross-section showing an adjustable coupling apparatus for a microstripline to cavity transition in accordance with the principles of the present invention.

FIG. 2 is a view in perspective of the apparatus shown in FIG. 1.

DETAILED DESCRIPTION OF THE PREFERRED EMBODIMENT

Referring to FIG. 1, a microstripline assembly is shown which includes microstripline foil 12 mounted on a dielectric substrate 14. A commercially available dielectric substrate may be utilized such as Duroid$^R$. The substrate 14 is under-surfaced with a ground foil 16 and attached to a carrier plate 17 to provide rigidity to the microstripline assembly. The ground foil 16 is preferably terminated at the edge of the carrier plate 17. The carrier plate 17 is affixed to the cavity wall 18.

For the embodiment as depicted, it has been found that thicknesses of these materials of approximately 62.5 mils (0.0625 inches) for the cavity wall 18, 125 mils for the carrier plate substrate 14 have provided satisfactory results although it is to be understood that this invention should in no way be restricted to those particular dimensions. The ground foil thickness is not critical, as is well known in the art. For further information regarding microstripline parameters, reference may be made to "Microstrip Lines for Microwave Integrated Circuits", M. V. Schneider, Bell System Technical Journal, May–June 1969, pp. 1421–1444.

An aperture in the microstripline assembly, as depicted above the top wall of the cavity, is used to insert an electric field probe 20. The probe 20 includes an outer bushing 22 and an adjustable cylinder 24. The outer bushing 22 is of a conductive material, preferably metal, and soldered to the microstripline foil 12 with the top of the bushing 22 being as flush with the microstripline foil 12 as possible. It has been found that allowing the top of the bushing to stand above the microstripline foil can cause significant losses due to radiation and may also result in an undesired reactance.

The bottom of the probe resides within a second aperture through the carrier plate 17 and the cavity wall 18. The bottom of the bushing 22 should not protrude past the inside of the cavity wall 18. Limiting the bushing in this manner helps to maintain a constant characteristic impedence through the carrier plate 17 and the cavity wall 18.

In the present embodiment, preferred approximate dimensions include: outer bushing diameter of 115 mils, cylinder diameter of 72 mils, and the outer bushing edges centered about the second aperture, and located 40 mils from the cavity wall.

The cylinder 24 within the bushing 22 is preferably the same type of metal as the bushing. A hollow or solid cylinder 24 is acceptable such that the inner diameter of the bushing 22 is less than 1/10th of the wavelength of the resonant frequency. In any event, the cylinder 24 must be capable of small incremental or continuous adjustments to allow variable coupling to the microstripline foil 12.

The particular amount of energy desired to be coupled out of the cavity is dependent upon the depth of the cylinder within the cavity. Mathematically, the probe can be represented as a variable transformer, having a coupling coefficient B, shunting an equivalent L-C-R parallel resonant circuit. Since the Q of the desired resonant frequency is defined as the center frequency divided by the 3 dB bandwidth, obtaining an appropriate coupling coefficient defines the 3 dB bandwidth at the center frequency. The coupling coefficient is defined as:

$$B+1=Q_0/Q,$$

where $Q_0$ is measure as B approaches 0. As the depth of the cylinder 24 increases, a somewhat linear correlation of B is desired. Accordingly, when the cavity is used at different frequencies, changing the depth of the cylinder will provide the desireed 3 dB bandwidth characteristic.

Although the electric field probe 20 can be manufactured to meet a particular application, the type JMC 6924–5 metallic tuning element made by Johanson Manufacturing Corporation has been found suitable for this purpose. The adjustable cavity to microstripline transition was installed in the sidewall of a waveguide with a short at one end and a coaxial adapter at the other end. In testing insertion loss with the type JMC 6924–5 part, coupling varied consistently with each rotation of the cylinder 24. Starting with the top of the cylinder 24 flush with the top of the bushing 22, the following insertion loss measurements resulted.

| Cylinder rotation (clockwise) | 7.1 GHz. | 7.5 GHz. | 7.8 Ghz. |
|---|---|---|---|
| 0 | −6.5 dB | −7.5 dB | −8.5 dB |
| 2 | −6.3 dB | −6.3 dB | −7.2 dB |
| 4 | −5.5 dB | −5.3 dB | −6.2 dB |
| 6 | −3.9 dB | −4.6 dB | −5.4 dB |
| 8 | −3.6 dB | −4.0 dB | −4.8 dB |
| 10 | −3.5 dB | −3.8 dB | −4.5 dB |
| 12 | −3.4 dB | −3.7 dB | −4.3 dB |

Hence, the adjustability of the coupling is well illustrated.

Referring now to FIG. 2, an enclosed cavity is shown with an overview of the adjustable coupling apparatus of FIG. 1. Energy is inserted into the cavity using a generator (not shown) through an opening 30. The energy is then coupled to the cylinder 24 of the probe 20, to the bushing 22 and down to the microstripline foil 12. As is well known in the art, quarter wavelength transformer matching along microstripline foil can be accomplished by fixing the width of the microstripline foil to achieve the appropriate intermediate characteristic impedance. Again, reference may be made to "Microstrip Lines for Microwave Integrated Circuits", supra. In the embodiment shown, the energy on the microstripline foil 12 is terminated at a 50 ohm output port, or preferably an SMA connector 32. A 50 ohm impedence looking into the connector 32 can be smoothly matched to the 32 ohm microstripline foil **12*a* through an intermediate quarter wavelength section of microstripline foil 12*b* having a 40 ohm characteristic impedence. The 31 mils thick substrate material used in this application, having a relative dielectric constant equal to 2.2, has corresponding foil widths of: for the 32 ohm foil (12*a*)-175 mils for the 40 ohm width (12*b*)-130 mils, and for the 50 ohm line (12*c***)-95 mils.

The present invention provides a cavity to microstripline transition having an adjustable electric field probe which can be positioned to efficiently and accurately couple a desired amount of energy at different resonant frequencies. Adjusting the probe requires no preformed manufactured parts and can be performed quickly without the necessity of replacing parts.

While the invention has been particularly shown and described with reference to a preferred embodiment, it will be understood by those skilled in the art that various other modifications and changes may be made to the present invention described above without departing from the spirit and scope thereof.

What is claimed is:

1. An adjustable cavity coupling arrangement adaptable for a microstrip transition, comprising:

an enclosed cavity defining an energy base from which energy may be coupled, said cavity having an aperture through one included wall;

adjustable probe means positioned inside said cavity wall aperture and movable with respect thereto for coupling at least a portion of said energy therefrom and including a fixed outer bushing having a cylindrically shaped core, said bushing mounted approximately flush with said microstripline transition on the side opposite the cavity, and an adjustable cylinder fitting inside said bushing core; and microstrip means disposed adjacent said aperture, said microstrip means being connected at one end thereof to said adjustable probe means and at the other end to external circuitry.

2. The transition according to claim 1, wherein said microstrip means further comprises:

a dielectric substrate terminating at said adjustable probe means at one end, and a ground foil terminating before said aperture at same said end.

3. An adjustable cavity coupling arrangement adaptable for a microstrip transition, comprising:

an enclosed cavity defining an energy base from which energy may be coupled;

a carrier plate having a bottom positioned on one wall of said cavity;

a layered microstripline transition having a top layer composed of a microstripline foil, a middle layer composed of a dielectric substrate and a bottom layer composed of a ground foil, said bottom layer connected to top of said carrier plate;

said layered microstripline transition having a first aperture therethrough;

said cavity wall and said carrier plate having a common second aperture larger than and centered about said first aperture; and an adjustable probe positioned inside said first and second apertures and movable with respect thereto for coupling said energy to said microstripline transition and including a fixed outer bushing having a cylindrically shaped core, said bushing mounted approximately flush with said microstripline transition on the side opposite the cavity, and a vertically adjustable cylinder fitting inside said bushing core.

4. The transition according to claim 3, wherein said layered microstripline transition further includes said bottom layer having one end terminated at said second aperture and said top layer terminated connected to said probe.

5. The transition according to claim 3, wherein said adjustable probe further comprises threaded means for adjusting said cylinder in said bushing.

6. The transition according to claim 3, wherein said adjustable probe means further comprises said bushing having an inner diameter less than 1/10th of the resonant frequency wavelength of said energy coupled onto said microstripline transition.

7. The transtition according to claim 3, wherein said adjustable probe further comprises said bushing extending up to the inside surface of said cavity wall.

* * * * *